US005728910A

United States Patent [19]

Matsubara et al.

[11] Patent Number: 5,728,910

[45] Date of Patent: Mar. 17, 1998

[54] OIL-FORMING METHOD OF CHLORINE-CONTAINING PLASTIC REFUSE

[75] Inventors: Wataru Matsubara; Hiroshi Makihara; Shigeo Hasegawa, all of Hiroshima-ken, Japan

[73] Assignee: Mitsubishi Jukogyo Kabushiki Kaisha, Tokyo, Japan

[21] Appl. No.: 735,420

[22] Filed: Oct. 22, 1996

[30] Foreign Application Priority Data

Oct. 23, 1995 [JP] Japan ..... 7-274189

[51] Int. Cl.[6] ..... C07C 1/00; C07C 1/26; C07C 7/152

[52] U.S. Cl. ..... 585/241; 585/843; 585/935; 208/952

[58] Field of Search ..... 585/241, 832, 585/833, 839, 843, 935; 208/952; 423/481, 488

[56] References Cited

U.S. PATENT DOCUMENTS 4,113,446 9/1978 Modell et al. ..... 48/209

FOREIGN PATENT DOCUMENTS 0 617 984 10/1994 European Pat. Off. .

56-501205 8/1981 Japan .

95 04796 2/1995 WIPO .

OTHER PUBLICATIONS

G. Degremont ed., Water Treatment Handbook, p. 887, 1973, France.

Database WPI, Section CH, Week 9502, Derwent Publications Ltd., London, GB; Class A35, AN 95-012107 XP002023238 & JP 06 299 169 A (Enomoto H), 25 Oct. 1994.

*Primary Examiner*—Glenn Caldarola

*Assistant Examiner*—Bekir L. Yildirim

*Attorney, Agent, or Firm*—Foley & Lardner

[57] ABSTRACT

To present an oil-forming method of chlorine-containing plastic refuse capable of obtaining oily product free from chlorine content, while suppressing apparatus corrosion by efficiently capturing hydrogen chloride generated by decomposition of chlorine-containing plastics, the oil-forming method of chlorine-containing plastic refuse is characterized by decomposing chlorine-containing plastic refuse using water in supercritical region as reaction medium and forming into oil, wherein silver nitrate of 0.8 to 2.0 times the reaction equivalent amount of hydrogen chloride generated by decomposition of chlorine-containing plastic refuse is added in the water as reaction medium to decompose and form into oil, and generated hydrogen chloride is removed in a form of silver chloride.

17 Claims, 2 Drawing Sheets

OIL-FORMING METHOD OF CHLORINE-CONTAINING PLASTIC REFUSE

FIELD OF THE INVENTION AND RELATED ART STATEMENT

The present invention relates to an oil-forming method for collecting useful oily matter from chlorine-containing plastic refuse such as vinyl chloride resin.

Hitherto, various plastic refuse was mostly disposed of by land filling or incineration process, not effectively utilized as resources. When disposing of plastic refuse by land filling, since it is bulky, the reclaimed land volume increases, and it is difficult to find the filling site or the ground is unstable after filling. By incineration process, since this refuse is a high calorie solid matter, the furnace damages are serious, and incineration is accompanied by release of harmful gas and foul smell.

In such background, recently, it has been attempted to regenerate and recycle waste plastics without causing pollution, and utilize effectively as resources. One of such methods is to decompose waste plastics by using water in supercritical region (supercritical water) as reaction medium and form into oil.

However, if plastic refuse containing chlorine-containing plastics is decomposed in such method, hydrogen chloride is generated to induce corrosion of the apparatus, and therefore, conventionally, the chlorine-containing plastics are screen and removed beforehand by pretreatment, and only plastic refuse not containing chlorine-containing plastics is formed into oil.

OBJECT AND SUMMARY OF THE INVENTION

When decomposing plastic refuse by using water in supercritical region and forming into oil as mentioned above, if chlorine-containing plastics such as vinyl chloride resins are contained in the plastic refuse, hydrogen chloride is generated by decomposition, and corrosion of apparatus may be induced.

It is hence a primary object of the invention to solve the problems in the prior art, and present an oil-forming method of chlorine-containing plastic refuse capable of obtaining oily product free from chlorine content, while suppressing apparatus corrosion by efficiently capturing hydrogen chloride generated by decomposition of chlorine-containing plastics.

It is also an object of the invention to suppress corrosion of later stage apparatus such as reactor and heat exchanger, by dissolving silver nitrate, equivalent to or more than the amount of hydrogen chloride generated by decomposition of chlorine-containing plastics, as corrosion inhibitor in water used as reaction medium, and capturing the produced hydrogen chloride in a form of silver chloride.

That is, the invention presents:

(1) an oil-forming method of chlorine-containing plastic refuse for decomposing chlorine-containing plastic refuse using water in supercritical region as reaction medium and forming into oil, wherein silver nitrate of 0.8 to 2.0 times the reaction equivalent amount of hydrogen chloride generated by decomposition of chlorine-containing plastic refuse is added in the water as reaction medium to decompose and form into oil, and generated hydrogen chloride is removed in a form of silver chloride, and (2) an oil-forming method of chlorine-containing plastic refuse for decomposing chlorine-containing plastic refuse using water in supercritical region as reaction medium and forming into oil, wherein water adding silver nitrate of 0.8 to 2.0 times the reaction equivalent amount of hydrogen chloride generated by decomposition of chlorine-containing plastic refuse is used as reaction medium, chlorine content in the chlorine-containing plastic refuse is generated in the condition of 200° to 600° C./1.55 to 40 MPa, the generated hydrogen chloride is caused to react with silver nitrate to remove in the form of silver chloride, and it is further decomposed in the condition of 374° to 600° C./22.1 to 40 MPa to form into oil.

The decomposition reaction of plastic refuse using water in supercritical region or supercritical water as reaction medium is usually conducted at temperature of 374° C., preferably 450° to 550° C., but when chlorine-containing plastic refuse is decomposed, hydrogen chloride is generated. In high concentration aqueous solution of hydrogen chloride, corrosion of metal material is excessive, and selection of material to be used in the reaction condition of supercritical water is extremely difficult. Therefore, for decomposition of chlorine-containing plastic refuse, same as in the prior art, either the method of removing chlorine-containing plastics by pretreatment screening, or the method of capturing the generated hydrogen chloride immediately should be required.

The method of removing chlorine-containing plastics by pretreatment screening is increased in the number of devices and is hence costly, and another problem is the treatment of the removed chlorine-containing plastic refuse. Accordingly, in the invention, the method of capturing the generated hydrogen chloride immediately was employed, and silver nitrate was selected as the capturing agent. Silver chloride produced by reaction with silver nitrate is extremely small in solubility in water, so that the apparatus corrosion may be suppressed.

In the invention, chlorine-containing plastic refuse may include not only the water composed of chlorine-containing plastics such as vinyl chloride alone, but also mixed waste with other plastics, and plastic refuse mainly containing chlorine-containing plastics, and other impurities than plastics may be also contained.

Incidentally, the method of the invention is not limited to the oil-forming method of chlorine-containing plastic refuse, but may be also applied in removal of hydrogen chloride generated at the time of treatment of chlorine-containing organic waste such as waste agricultural chemical and PCB.

DETAILED DESCRIPTION OF THE PREFERRED EMBODIMENTS

Figure 1:
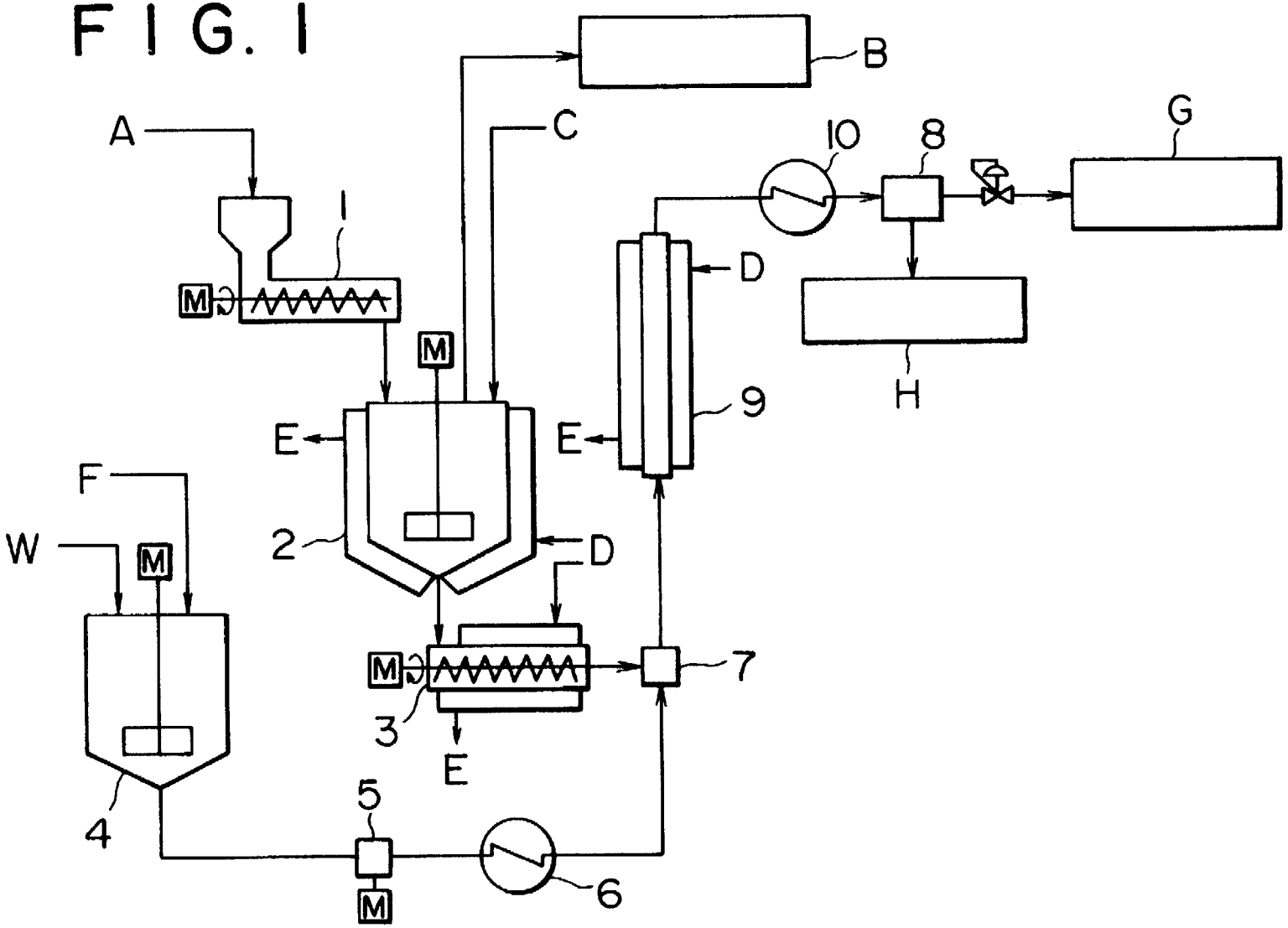
FIG. 1 is a schematic explanatory diagram showing a constitution of apparatus according to an embodiment of the invention.

Referring now to the drawings, the invention is described in detail below.

FIG. 1 is a schematic explanatory diagram showing a constitution of apparatus according to an embodiment of the invention. In the apparatus in FIG. 1, chlorine-containing plastic refuse A is fed into vertical or lateral dissolving tank 2 having agitating means through a feeder 1. The chlorine-containing plastic refuse heated and dissolved at a temperature of 200° to 400° C., preferably 250° to 300° C. in the dissolving tank 2 is pressurized by a pressurizing device 3 having a screw of one shaft or two or more shafts with a conveying mechanism, and is continuously fed under pressure into a mixing tank (or mixing pipe) 7. The pyrolysis gas containing hydrogen chloride generated by partial decomposition of chlorine-containing plastic refuse at the time of dissolving is discharged from the upper portion of the dissolving tank 2, and is sent into an exhaust gas treating process B. To reduce the melt viscosity, part C of generated oil being formed in oil and recovered may be fed again into the dissolving tank 2.

Symbol D is heated gas, which is supplied into the dissolving tank 2 and jacket of the pressurizing device 3. Symbol E is its exhaust gas. They are same also in the reactor 9 described below.

On the other hand, in a water adjusting tank 4, silver nitrate F of 0.8 to 2.0 times, preferably 1.0 to 1.1 times the theoretical output of hydrogen chloride generated by decomposition of chlorine-containing plastic refuse is dissolved in water W. This water is sent by a pump 5, and heated to 200° to 600° C., preferably 250° to 400° C., in a preheater 6, and is continuously fed under pressure into the mixing tank (or mixing pipe) 7, and is mixed with chlorine-containing plastic refuse in molten state. The adding amount of water W is preferably in a range of 0.05 to 0.3 by weight as the ratio of chlorine-containing plastic refuse to water.

The mixture of chlorine-containing plastic refuse in molten state and water dissolving silver nitrate is heated to 374° to 600° C., preferably 450° to 550° C. in the reactor 9, and is decomposed into hydrogen carbide of low molecular weight in a short time in a supercritical state of pressure of 22.1 to 40 MPa (mega pascal). The hydrogen carbide of low molecular weight can be decomposed into any desired state from heavy oil to light oil by properly selecting the reaction temperature, reaction pressure, mixed ratio of plastic refuse/water, and reaction time in the reactor 9.

In the pressurizing device 3, mixing tank (or mixing pipe) 7 and reactor 9, hydrogen chloride generated by decomposition of chlorine-containing plastic reacts with silver nitrate dissolved in water, and silver chloride precipitates. This reaction is shown in formula (1). The mixture of hydrogen carbide of low molecular weight released from the reactor 9 and the water in supercritical region is cooled by a cooler 10, and the precipitating silver chloride is separated by solid-liquid separator 8, and is sent to a subsequent separation and recovery process G. The silver chloride separated in the solid-liquid separator 8 is sent into a silver nitrate regeneration process H, and silver nitrate is regenerated and recycled.

$$HCl+AgNO_3 \rightarrow AgCl+HNO_3 \quad (1)$$

Figure 2:
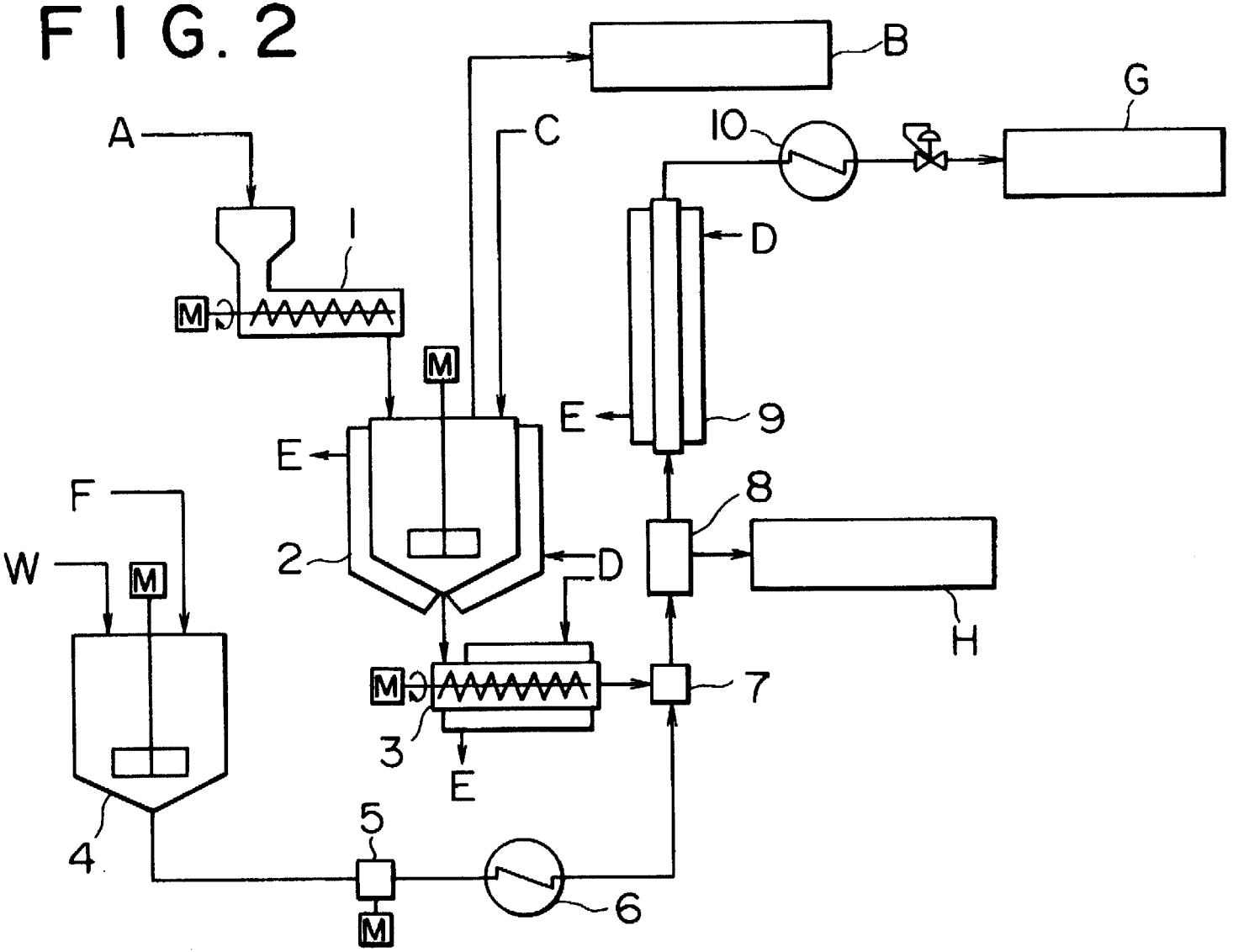
FIG. 2 is a schematic explanatory diagram showing a constitution of apparatus according to other embodiment of the invention.

FIG. 2 shows a constitution of apparatus according to other embodiment of the invention. In FIG. 2, same elements as in FIG. 1 are identified with same reference numerals and explanations are omitted.

In this embodiment, in the process up to the mixing tank (or mixing pipe) 7, in the condition of 200° to 600° C./1.55 to 40 MPa, almost all quantity of hydrogen chloride is generated, and the precipitating silver chloride is separated in the solid-liquid separator 8 installed before the reactor 9, and this mixture is fed into the reactor 9, and the separation reaction is completed at 374° to 600° C., preferably 450° to 550° C. and pressure of 22.1 to 40 MPa in supercritical state. In this embodiment, it is effective to avoid risk of clogging in the reactor 9 due to generated silver chloride.

[EXAMPLES]

Referring to the following examples, the method of the invention is more specifically described below.

(Examples)

Using the apparatus shown in FIG. 2, oil-forming tests were conducted by using polyethylene (PE), polypropylene (PP), polystyrene (PS), polyvinyl chloride (PVC), and their mixture.

In the testing method, each sample was dissolved in the dissolving tank 2 kept at 270° C., and mixed with water heated to 350° C. (in tests 4 and 5, water dissolving silver nitrate by 1.05 equivalent to the theoretical generation quantity of hydrogen chloride) in the mixing tank 7, and was fed into the reactor 9 for oil-forming reaction directly in tests 1 to 3, and after removing the precipitating silver chloride in the solid-liquid separator 8 in tests 4 and 5. The reaction conditions and results are shown in Table 1.

As known from Table 1, according to the oil-forming method of the invention, a high removal rate of hydrogen chloride over 99% and a high oil-forming rate are obtained in chlorine-containing plastics.

The invention, however, is not limited to these examples, but may be changed and modified in various forms without departing from the scope and true spirit of the method of the invention.

TABLE 1

| | | | Test No. | | | | |
|---|---|---|---|---|---|---|---|
| | | | 1 | 2 | 3 | 4 | 5 |
| Condition | Reaction Temperature (°C.) | | 500 | 500 | 500 | 500 | 500 |
| | Reaction Pressure (MPa) | | 30 | 30 | 30 | 30 | 30 |
| | Plastics/water retio by weight(–) | | 0.15 | 0.15 | 0.15 | 0.15 | 0.15 |
| | Reaction time (min) | | 2 | 2 | 0.5 | 2 | 2 |
| | Sample composition wt % | PE | 100 | 0 | 0 | 0 | 32 |
| | | PP | 0 | 100 | 0 | 0 | 21 |
| | | PS | 0 | 0 | 100 | 0 | 24 |
| | | PVC | 0 | 0 | 0 | 100 | 23 |
| Product | Transforming rate wt % | Gas | 7 | 10 | 6 | 21 | 14 |
| | | Oil | 93 | 90 | 94 | 34 | 75 |
| | | Residue | 0 | 0 | 0 | 3 | 1 |
| | | HCl | — | — | — | 42 | 10 |
| | HCl removal rate (wt %) | | — | — | — | 99.4 | 99.9 |
| Cholorine content in produced oil | | | — | — | — | 0.7 | ≦0.1 |

According to the oil-forming method of plastic refuse of the invention, hydrogen chloride can be removed efficiently from chlorine-containing plastic refuse, and decomposition and transformation into oil can be conducted without practical risk of corrosion of the apparatus. The obtained oily product is almost free from chlorine content, and is effectively usable as fuel oil or other resource.

We claim:

1. An oil-forming method of chlorine-containing plastic refuse for decomposing chlorine-containing plastic refuse using water in supercritical region as reaction medium and forming into oil, wherein silver nitrate of 0.8 to 2.0 times the reaction equivalent amount of hydrogen chloride generated by decomposition of chlorine-containing plastic refuse is added in the water as reaction medium to decompose and form into oil, and generated hydrogen chloride is removed in a form of silver chloride.

2. An oil-forming method of chlorine-containing plastic refuse for decomposing chlorine-containing plastic refuse using water in supercritical region as reaction medium and forming into oil, wherein water adding silver nitrate of 0.8 to 2.0 times the reaction equivalent amount of hydrogen chloride generated by decomposition of chlorine-containing plastic refuse is used as reaction medium, chlorine content in the chlorine-containing plastic refuse is generated in the condition of 200° to 600° C./1.55 to 40 MPa, the generated hydrogen chloride is caused to react with silver nitrate to remove in the form of silver chloride, and it is further decomposed in the condition of 374° to 600° C./22.1 to 40 MPa to form into oil.

3. A method of decomposing chlorine-containing plastic refuse, comprising contacting molten chlorine-containing plastic refuse with water in the supercritical region of temperature and pressure to form an oil and byproduct hydrogen chloride, and reacting the hydrogen chloride byproduct in situ with silver nitrate, in an amount of from 0.8 to 2.0 times the theoretical reaction equivalent of said hydrogen chloride, whereby the hydrogen chloride is removed as silver chloride.

4. The method according to claim 3, wherein the hydrogen chloride byproduct is generated from partial decomposition of the chlorine-containing plastic refuse at a temperature of 200° to 600° C. and a pressure of 1.55 to 40 MPa, and the silver nitrate is reacted with the hydrogen chloride prior to further decomposition of the plastic refuse to the oil at a temperature of 374° to 600° C. and a pressure of 22.1 to 40 MPa.

5. The method according to claim 3, wherein the silver nitrate is reacted with the hydrogen chloride during decomposition of the plastic refuse to the oil at a temperature of 374° to 600° C. and a pressure of 22.1 to 40 MPa.

6. The method according to claim 4, wherein the plastic refuse is decomposed into the oil at a temperature of 450° to 550° C. and a pressure of 22.1 to 40 MPa.

7. The method according to claim 5, wherein the plastic refuse is decomposed into the oil at a temperature of 450° to 550° C. and a pressure of 22.1 to 40 MPa.

8. The method according to claim 4, wherein the silver nitrate is present in an amount of from 1.0 to 1.1 times the theoretical reaction equivalent of the hydrogen chloride.

9. The method according to claim 5, wherein the silver nitrate is present in an amount of from 1.0 to 1.1 times the theoretical reaction equivalent of the hydrogen chloride.

10. The method according to claim 4, wherein the chlorine-containing plastic refuse is heated to a temperature of 200° to 400° C. to produce the molten chlorine-containing plastic refuse.

11. The method according to claim 5, wherein the chlorine-containing plastic refuse is heated to a temperature of 200° to 400° C. to produce the molten chlorine-containing plastic refuse.

12. The method according to claim 10, wherein the chlorine-containing plastic refuse is heated to a temperature of 250° to 300° C. to produce the molten chlorine-containing plastic refuse.

13. The method according to claim 11, wherein the chlorine-containing plastic refuse is heated to a temperature of 250° to 300° C. to produce the molten chlorine-containing plastic refuse.

14. The method according to claim 4, wherein the chlorine-containing plastic refuse comprises polyvinyl chloride.

15. The method according to claim 5, wherein the chlorine-containing plastic refuse comprises polyvinyl chloride.

16. The method according to claim 4, further comprising the step of regenerating silver nitrate from the silver chloride.

17. The method according to claim 5, further comprising the step of regenerating silver nitrate from the silver chloride.

* * * * *